United States Patent [19]

Moses

[11] 4,055,361

[45] Oct. 25, 1977

[54] DOOR LOCK ATTACHMENT

[76] Inventor: Adolph Moses, 8 E. 83rd. St., New York, N.Y. 10028

[21] Appl. No.: 622,405

[22] Filed: Oct. 14, 1975

[51] Int. Cl.[2] ..... E05B 13/00

[52] U.S. Cl. ..... 292/359; 70/416

[58] Field of Search ..... 292/359; 70/416

[56] References Cited

U.S. PATENT DOCUMENTS

| | | | |
|---|---|---|---|
| 179,943 | 7/1876 | Neracher | 292/359 |
| 956,947 | 5/1910 | Curlett | 292/359 |
| 991,018 | 5/1911 | Powers | 292/359 |
| 2,125,518 | 8/1938 | Oldham | 292/359 |
| 2,400,403 | 5/1946 | Falk | 292/359 |
| 3,065,624 | 11/1962 | Friedman | 292/359 X |

FOREIGN PATENT DOCUMENTS

| | | | |
|---|---|---|---|
| 517,022 | 7/1939 | United Kingdom | 292/359 |

*Primary Examiner*—Roy D. Frazier
*Assistant Examiner*—Peter A. Aschenbrenner

[57] ABSTRACT

A thumb-knob assembly for preventing a mortise lock from being opened from the outside even by a proper key. My thumb-knob assembly may be the one shipped with the mortise lock or may be bought separately and substituted for the thumb-knob assembly that was originally installed. It affords better protection than an extra bolt or a night-latch without their installation cost, is superior in appearance, and its installed cost should be less.

8 Claims, 12 Drawing Figures

DOOR LOCK ATTACHMENT

The common mortise lock used on entrance doors to homes, hotel and motel rooms does not provide protection to room occupants against entry by personnel with passkeys or people who are familiar with the various methods of operating a lock without the use of its key. Protection against such confrontation is normally obtained by installing on the inside a bolt or a night-latch, on which the occupant can shift a button to prevent it from being opened from the outside. As commonly installed, the extra bolt or the night-latch does not offer as much resistance against forcable entry as does a mortise lock.

My attachment, when substituted for the usual thumb-knob assembly, furnished with mortise locks, enables the latter to function as do night-latches and dead bolts. Its installed cost should be less than that for the latter.

My thumb-knob assembly could be packed in place of the usual thumb-knob assembly furnished with mortise locks. It requires no alteration of the lock itself or the tools to make it.

In addition to the market for new mortise locks, there is the vast market afforded by mortise locks that have already been installed over the years.

I have deliberately made the body large so that it will not leave unpainted portions on the door when my assembly is substituted for the original one.

The screws that attach the thumb knob assembly to the door are usually located on a vertical line and often spaced 1⅛ inches apart, and my assembly may have its attaching screw holes so placed. Since the spacing of the attaching screws varies, I have located mine so that normally my assembly will be installed with the attaching screws on a horizontal line where there is little likelihood of need to plug up holes when substituting my assembly for the one that has been in use. This makes for a more secure attachment to the door.

All the FIGS. except FIG. 12 are shown twice size for clarity.

FIG. 1 is a door-side view of the assembly with the back plate 11 removed and the stop 13 disengaged from the thumb-knob hub 31.

Figures 1, 2, 3, 4, 5, 6, 7, 8, 9, 10, 11, 12:
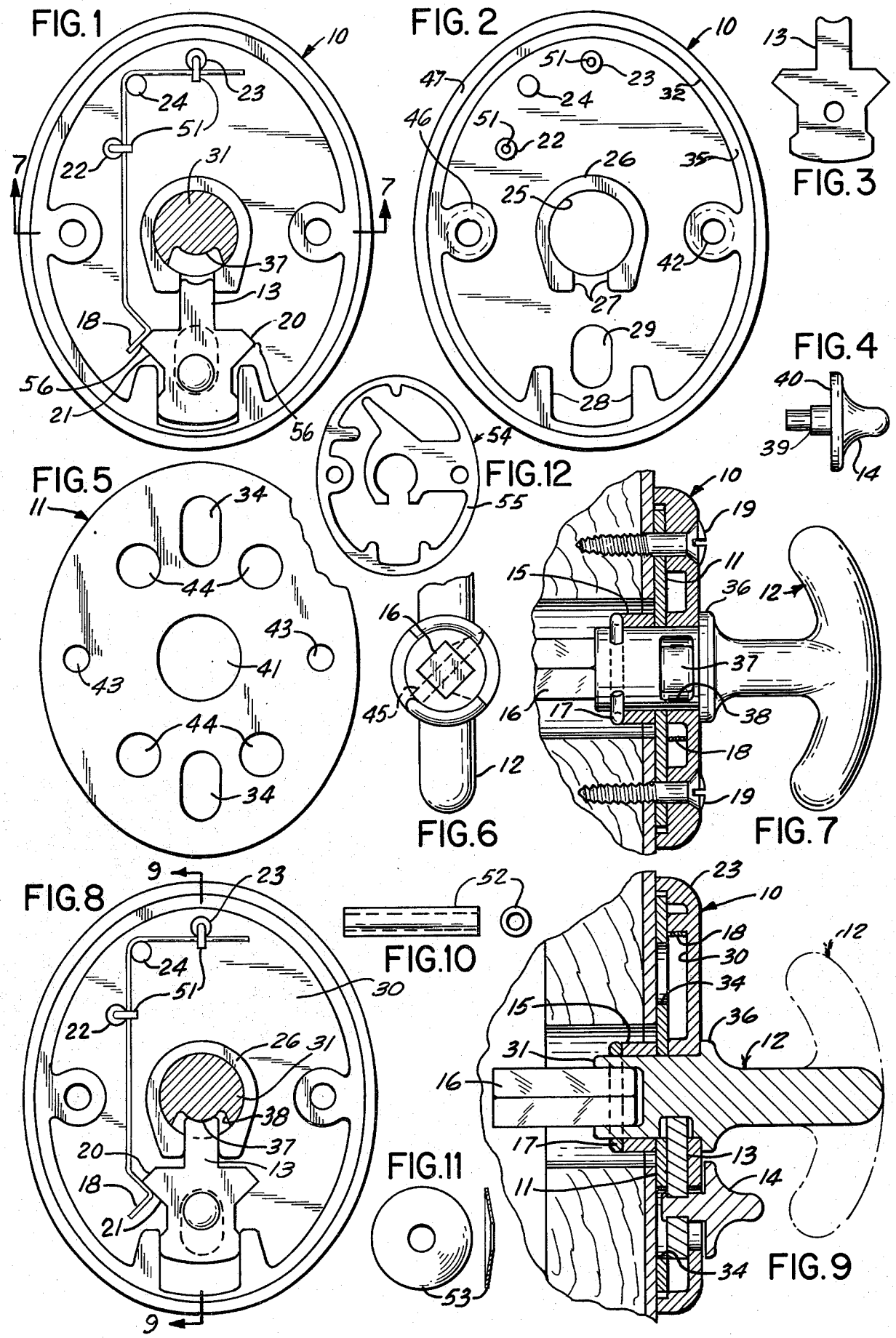
FIG. 2 is a door-side view of the body 10.
FIG. 3 is an elevation of the stop 13.
FIG. 4 shows the stop actuating knob 14.
FIG. 5 is an elevation of the back plate 11.
FIG. 6 is a door-side end view of the thumb-knob 12.

FIG. 7 is a rotated sectional view taken on line 7—7 of FIG. 1, except that thumb-knob 12, spindle 16, and pin 17 are not sectioned.

FIG. 8 is a door-side view of the assembly with the back plate 11 removed and the stop 13 engaged with the thumb-knob hub 31 recess 37.

FIG. 9 is a sectional view taken on line 9—9 on FIG. 8.

FIG. 10 depicts the bushing 52 that may be used to facilitate drilling the door for the attaching screws.

FIG. 11 shows the knob washer 53 for use when back plate 11 is omitted.

FIG. 12 is a plan view of an alternate sheet metal body stamping.

There are numerous ways in which the invention can be constructed. I have chosen, for patent purposes, to show a conventional construction, using a body 10 of die cast brass, a back plate 11 stamped from steel strip, a thumb-knob 12 being a brass die casting, a stop 13 stamped from steel strip, a stop actuating knob 14 made on an automatic screw machine from brass rod. The spacer 15 may be made from steel rod or tube or rolled strip, the spindle 16 made of square steel stock, the pin 17 is made of soft steel or brass wire. 18 is a detent spring formed from spring steel wire. 19 are standard oval countersunk brass wood-screws, or preferably plated self-tapping steel screws.

DESCRIPTION OF EMBODIMENT SHOWN

The body 10 shown in FIG. 2 has a hole 25 partially surrounded by boss 26, which has an opening bounded by surfaces 27, which, with surfaces 28, prevent the stop 13 from rotating about the axis of the thumb-knob 12.

The stop 13 is made so that it cannot be accidentally assembled incorrectly in the body 10 before the button 14 is inserted through slot 29 in body 10 and rived to stop 13. The spring 18 is then placed over lug 24 (FIG. 8) sprung against lugs 22 and 23, and then pushed down against the surface 30 (FIG. 9) of body 10. The stop 13 should be in inoperative position shown in FIG. 1 with the spring 18 contacting one of the surfaces 20 (FIG. 1), thus biasing stop 13 to its inoperative position. The thumb-knob hub 31 is then inserted in hole 25 with the thumb-knob shoulder 36 against body 10 as in FIGS. 1 & 7. Next, hole 41 in the back plate 11 is slipped over hub 31 until the back plate 11 is inside the rim 32 (FIG. 2) and contacts the surface 35. There are two openings 34 symmetrically located in back plate 11 to prevent incorrect assembly. The spacer 15 is then slipped over hub 31, the spindle 16 inserted in hub 31 (FIGS. 6 & 7), the pin 17 inserted through the holes 45 in hub 31 and in spindle 16, then bent around the hub 31 as is customary, to form an "S" shape.

When the thumb-knob 12 is positioned as in FIGS. 8 & 9, the knob 14 may be pushed towards the thumb-knob 12 axis until stop 13 bottoms in the recess 37. The spring 18 will then contact one of the surfaces 21 on stop 13 as in FIG. 8. Rotation of the thumb-knob 12 and its spindle 16 will then be limited by one of the ends 38 of recess 37 in thumb-knob hub 31. To allow for play in the lock and of the spindle 16 in the lock and in the hub 31 and for manufacturing tolerances, ends 38 in recess 37 are spaced far enough apart to permit stop 13 to enter recess 37 when the thumb-knob is in the bolt extended position. The play thus permitted will leave the lock dead bolt and latch sufficiently engaged with the lock strike so that even a proper key will not permit entrance when the stop 13 is in engagement with recess 37. It should be noted that the torque on the thumb-knob hub 31 is a small fraction of the torque applied to the lock key. Also the torque that the key can transmit is limited by the small section of the key and its weak material.

The stop 13 is thin enough to move freely between the back plate 11 and body 10.

The shoulder 39 on knob 14 (FIG. 4) should be far enough from face 40 so that if knob 14 is pushed in toward the door, surface 40 on knob 14 will not contact the outer polished surface of body 10 and mar it when the knob 14 is shifted.

Holes 42 in body 10 are cast for the attaching screws 19 and holes 43 are pierced in back plate 11 for attaching screws 19.

Holes 44 in back plate 11 permit observing the functioning of spring 18 regardless of how back plate 11 is assembled. This is accomplished by symmetrically locating them about its two axes, which are perpendicular to each other. They are optional but useful during final inspection.

It is obvious that the thumb-knob assembly may be fastened on the door with the stop 13 above or below, to the right or left of the thumb-knob 12 axis. I prefer it to be placed on the door as shown in FIG. 1, so in the unlikely event of spring 18 failure, or in the unlikely event that the knob 14 had not been pushed far enough so that the stop point 56 was not beyond the dead center contact with spring 18, the stop 13 would not drop or be jarred down into engagement with recess 37 and thus accidentally lock one out.

Many of the usual thumb-knob assemblies are fastened to the door by screws spaced $1\frac{1}{8}$ inches apart on a vertical centerline. If one desired to use the existing screw holes on a vertical line, the assembly should be installed with knob 14 to the left of the axis of thumb-knob 12 so that a broken spring 18 would drop away from the stop 13 and be incapable of jamming it.

The back plate 11 is shown because it is usually furnished with night-latches. When the back plate is used, the body 10 should be cast without the tits 51 on lugs 22 & 23.

I would dispense with the back plate 11 and lengthen spacer 15 by the thickness of back plate 11, & extend the faces of hubs 46 to the plane of surface 47 (FIG. 2). The body 10 could then be cheapened by eliminating the rim surface 35.

If the back plate 11 is used, body 10 would be cast without the tits 51 on lugs 22 & 23. If the back plate 11 is not used, the tits 51 would be bent over on spring 18 as in FIG. 1 to insure proper retention of spring 18.

The relatively costly separate spindle 16 is commonly used to compensate for the frequently inaccurate location of the thumb-knob body 10 on the door. Heretofore, when the spindle 16 has been made integral with thumb-knob hub 31, the spindle has been made much smaller than the square hole into which it fits in the lock. It thus must be small to allow for its being out of alignment. There is then the risk that after wear takes place, it will slip around in the square hole in the lock. Then one could not control the bolt from the inside.

By clamping the assembly to the door and checking the free rotation of the thumb-knob 12, then drilling in the door with the use of bushing 52 shown in FIG. 10, the body 10 may be accurately located so that the use of a small square separate spindle 16 will not be required. Then pin 17 and the drilling for it and its bending over can also be eliminated. The pin 17 and spacer 16 can then be replaced by a snap-ring located in a groove in the hub 31 on the door-side of the back plate 11. In the event that the back plate 11 is eliminated, the groove in hub 31 for the snap-ring should be placed in the space formerly occupied by the back plate 11.

The use of a snap-ring permits shipping the attachment with the thumb-knob 12 unassembled, thereby reducing assembly costs and permitting the use of a smaller container.

If the back plate 11 is omitted, I would place a nylon washer 53 (FIG. 11.) between body 10 and surface 40 on knob 14 (FIGS. 4 & 9) to prevent the button 14 from marring the polished surface of body 10. I prefer the thin nylon washer 53 to be slightly dished to form a truncated cone and assembled with the base of the cone next to the body 10. The dished washer 53 would function as a belleville spring, thus effectively sealing opening 29 in body 10 (FIG. 2), and compensating for the manufacturing tolerances in thickness of wall 30 of body 10 (FIG. 9) and shoulder 39 distance to surface 40 of knob 14 (FIG. 4).

I have so far described only the cast body embodiment to avoid lengthening this application. However, a sheet steel stamping 54 (FIG. 12) could be designed to form the body and a sheet brass front cover designed to cover the body. Then it probably would be advisable to retain the back plate 11. The front cover inside view would resemble FIG. 2 except the following would be eliminated: bosses 26 and 46, surfaces 27 and 28, lugs 22, 23, and 24, and ridge 35.

It might be advisable to laminate the stamped body 54, FIG. 12.

What is claimed is:

1. A thumb knob and stop assembly including a spindle for cooperation with a door latch assembly comprising a body, means carried by the body for affixing it to a door, said body having a hole surrounded by a boss, a thumb-knob having a cylindrical hub rotably disposed and retained within the hole in said boss, a spindle coupling said hub and the door latch assembly when said body is secured to the door, said body having a slot lying along a line intercepting the axis of said hub, an actuating knob having a pin projecting therefrom and extending through said slot, said slidable knob being movable between first and second positions lengthwise of said slot, a stop member carried by said pin, said body further comprising spaced means lying along said line and forming a recess slidably engaging a first end of said stop, a recess in said boss also lying along said line and slidably receiving the other end of said stop member, whereby said stop member is restricted to sliding movement, a recess in said hub, said other end of said stop when in said first position extending through said boss and into the recess in said hub and restricting rotation thereof and in said second position being retracted from engagement with said hub, said stop further including biasing means and spring means contacting said biasing means whereby said spring means will maintain said stop in either its first or second positions.

2. A thumb knob and stop assembly according to claim 1 wherein said body includes an overlying cover.

3. A thumb knob and stop assembly according to claim 1 wherein said body includes at least three lugs, and said spring includes means firmly engaging said lugs for support of said spring and maintaining it in contact with the biasing means on said stop member.

4. A thumb knob and stop assembly according to claim 1 wherein said lugs include means for maintaining said spring in engagement therewith.

5. A thumb knob and stop assembly according to claim 1 wherein the recess in said hub has a greater width than the other end of said stop.

6. A thumb knob and stop assembly according to claim 1 wherein said stop member is symmetrical about the line of movement thereof.

7. A thumb knob and stop assembly according to claim 1 wherein the recess in said hub has a recess greater than the width of the other end of said stop member and rotation of said thumb knob is restricted by engagement of said stop with a wall of said recess.

8. A thumb knob and stop assembly according to claim 1 including a resilient washer carried by said pin and underlying said actuating knob.

* * * * *